United States Patent [19]

Gaitten et al.

[11] 4,141,648

[45] Feb. 27, 1979

[54] PHOTOCONDUCTOR CHARGING TECHNIQUE

[75] Inventors: Ronald E. Gaitten, Boulder; Gerald L. Smith, Broomfield, both of Colo.

[73] Assignee: International Business Machines Corporation, Armonk, N.Y.

[21] Appl. No.: 750,936

[22] Filed: Dec. 15, 1976

[51] Int. Cl.[2] ..... G03G 15/14; H01T 19/04; G03G 21/00

[52] U.S. Cl. ..... 355/14; 250/325; 355/3 CH; 355/15; 361/229

[58] Field of Search ..... 355/3 R, 3 CH, 3 DD, 355/14, 15; 250/325, 326; 361/229, 235

[56] References Cited

U.S. PATENT DOCUMENTS

| | | | |
|---|---|---|---|
| 2,778,946 | 1/1957 | Mayo | 250/325 |
| 3,122,634 | 2/1964 | King | 250/326 |
| 3,527,941 | 9/1970 | Culhane et al. | 361/235 X |
| 3,656,021 | 4/1972 | Furuichi et al. | 250/326 X |
| 3,676,117 | 7/1972 | Kinoshita | 250/326 X |
| 3,700,328 | 10/1972 | Davidge et al. | 355/14 X |
| 3,736,055 | 5/1973 | Davidge et al. | 355/14 |
| 3,990,791 | 11/1976 | Tsukada | 355/14 |

OTHER PUBLICATIONS

Noto, Fedele A., "Copier with Single Corona Generating Device", Xerox Disclosure Journal, vol. 1, No. 2, Feb. 1976, p. 93.

*Primary Examiner*—Fred L. Braun
*Attorney, Agent, or Firm*—Joscelyn G. Cockburn

[57] ABSTRACT

A two cycle process electrophotographic copying device having charging, imaging, developing, transferring, and cleaning facilities, the arrangement being in the conventional sense, incorporates a combined charge and preclean corona unit that is operable to perform either a charging function or a precleaning function at the proper time during a copying/cleaning cycle and a combined precharge/transfer corona unit. The combined charge and preclean corona unit includes a dual bay corona which emits negative and positive ions and a common control grid for controlling the ion flow from each bay of the dual bay corona.

13 Claims, 4 Drawing Figures

PHOTOCONDUCTOR CHARGING TECHNIQUE

RELATED APPLICATION

The copending application of Gerald Lee Smith, Ser. No. 750,800 filed Dec. 15, 1976 and commonly assigned is incorporated herein by reference. The application of Gerald Lee Smith is a continuation-in-part of application Ser. No. 580,643, filed May 27, 1975, now abandoned.

BACKGROUND OF THE INVENTION

1. Field of the Invention

The invention relates to an electrophotographic copying device and, more specifically, to an improvement over the charging and cleaning of the support surface, also known as photoconductor on which the latent image of an original is developed.

2. Prior Art

The following U.S. Patents are representative of the prior art: U.S. Pat. Nos. 3,647,293; 3,637,306; and 3,736,055.

Numerous prior art teachings in the field of electrophotographic copying teaches various methods and devices for preparing or charging the surface of a photoconductor so as to obtain a latent image from an original document. Prints are then transferred from the latent image on the surface of the photoconductor, to a transferring media.

To enable the development of the latent image on the photoconductor and the transferring of said latent image to a transferring media, several stations are arranged in proximity to and to cooperate with the photoconductor to perform certain functions. At the charging station, the photoconductor is charged to a selective polarity, be it positive or negative. The photoconductor then moves to the exposing or imaging station where a latent image is copied from the original document. Next, the electrostatic latent image is developed at a developer station to form a toned image on the photoconductor. The toned image is then transferred from the photoconductor to another media at the transferring station. To complete the cycle, the photoconductor is erased, precleaned, and cleaned and is then ready for another cycle.

Although the prior art electrophotographic devices function adequately for the intended purpose, several problems plague these systems.

Probably one of the most pressing problems is the fact that the charging, transferring and precleaning functions are all performed by separate coronas at separate stations. These systems are referred to as a three corona type system. With this type of prior art design, the cost of the electrophotographic device is relatively high, due to the individual cost of each corona. Since the general trend is to minimize the cost of electrophotographic devices without sacrificing efficiency or copy quality, any reduction in the number of component counts, in the prior art devices, will be welcome.

Another problem relating to the separate processing station is the fact that each of the separate coronas require a separate power supply. The aggregate cost of these power supplies further augments the overall cost of the unit. As such, any reduction in the number of power supplies will reduce the cost of the unit.

It is common knowledge that conventional electrophotographic devices may be either a single cycle process or a two cycle process. In the typical two cycle process the photoconductor is charged, imaged and developed during the first cycle while the image is transferred and the photoconductor is cleaned in the second cycle. For satisfactory operation, some of the stations which render necessary functions during the copying process are active during the first cycle, while others are inactive and vice versa. On account of the rapid speed at which the photoconductor accesses each of the stations, it is, therefore, necessary for high speed switching to occur at these stations. The conventional 60 cycle power supply which is used for supplying power to these stations cannot withstand high speed switching. With these drawbacks, it is clear that a more efficient device which utilizes a more efficient charging technique is needed.

Several attempts have been made to improve the prior art electrophotographic devices by solving some of the above identified problems. For example, attempts have been made to combine the charge and the transfer corona station. At first blush, this combination seems to be workable and logical since the function of both stations is to supply charges having a given polarity. However, the combination, instead of solving the above described problems, creates additional problems.

One of the additional problems stems from the fact that the combined charge transfer station is designed with a grid structure to enhance the charge operation. However, transferring media which is fed into the machine at the charge/transfer station for transferring the latent image from the photoconductor jams into the grid wires. This jam results in machine breakdown.

For proper operation, if the charge on the toned image is positive, a negative charge has to be deposited onto the transferring media so that the positively charged toner particles will be attracted. Of course, if the toner is negatively charged then the transferring media has to be charged positively. With the presence of the grid assembly in the combined charge/transfer station, the charge (negative or positive) cannot be uniformly distributed onto the transfer media. With an uneven distribution of charges, the quality of the final copy is less than satisfactory.

OBJECTS OF THE INVENTION

It is, therefore, the object of the invention to design a more efficient, low cost electrophotographic device than was heretofor possible.

It is a further object of this invention to combine the preclean and charge coronas into a single unit. The single unit incorporates a dual bay corona with one bay for overcharging and another bay for reducing and/or smoothing the charge.

It is still a further object of the present invention to use the transfer corona station to render some of the precharging and the transferring functions.

It is still another object of the invention to utilize the combined precharge and transfer corona to render either the precharging of the photoconductor or the charging of the transfer media with said corona being set at one current level.

It is still another object of the invention to provide a corona configuration that is usable in a two cycle process but does not require power supply switching (except for the grid supply).

It is still another object of the invention to provide a corona configuration that will develop a smoother charge distribution on the photoconductor than was possible.

SUMMARY OF THE INVENTION

The present invention overcomes the aforementioned drawbacks in the prior art by means of a unique structural combination of processing stations within the copying process. More specifically, the combination allows the use of a two corona system for charging and/or precleaning the photoconductor and for charging the transferring media in a two cycle process. In one feature of the invention, during the first cycle, the photoconductor is precharged to a first potential which may be more or less than its operating potential. The charging is performed by the combined precharge transfer corona (called a Corotron): The charge or first potential is then augmented to an overcharge by one bay of a dual bay corona which forms the combined charge/preclean corona (called a Scorotron). The other bay of the dual bay corona then reduces and smoothes the overcharge of the photoconductor to the operating potential of said photoconductor.

The interimage erase lamp discharges the border area and/or no copy area of the photoconductor.

Imaging and developing also occurs during this first cycle.

During the overcharging and smoothing of the photoconductor the dual bay corona is controlled by a single gridded structure.

During the second cycle of the two cycle process, the toned image is transferred to the transferring media using the same precharge transfer corona (Corotron). Following transfer, the drum is charged and/or discharged by the charge/preclean corona to a second potential for cleaning. In order to place the second charge or potential on the photoconductor, the grid of the charge/preclean corona is switched to a different voltage level which may be of the opposite polarity. Of course, the setting is chosen so as to obtain best cleaning. The photoconductor is then (optionally) erased by the interimage erase lamp, and cleaned by the developer/cleaner station.

In another feature of the invention, power is supplied to the precharge transfer corona and one bay of the dual bay corona by a common power supply.

In still another feature of the invention, both the overcharging and the smoothing function is achieved by the dual bay corona. In this configuration, the precharge transfer corona is used for only charging the transfer media.

The foregoing and other objects, features and advantages of the invention will be apparent from the following more particular description of the preferred embodiment of the invention, as illustrated in the accompanying drawings.

DETAILED DESCRIPTION

Figure 1:
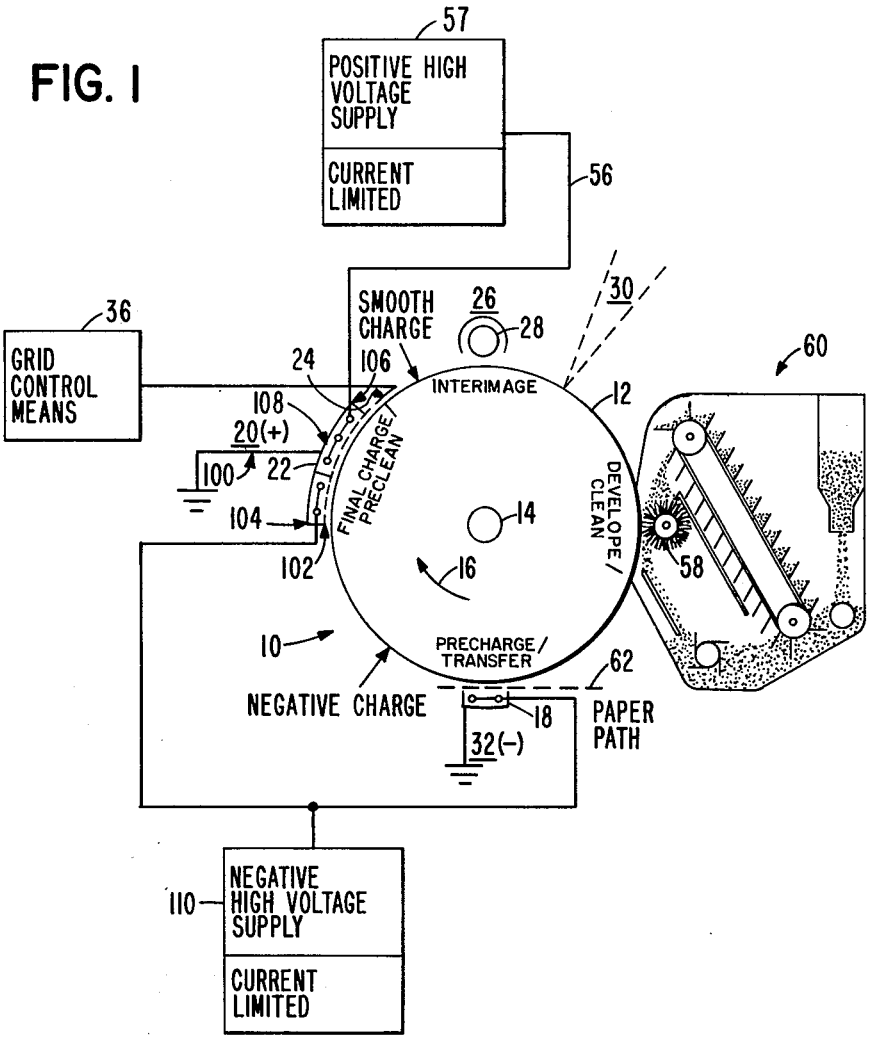
FIG. 1 shows the photoconductor of an electrophotographic machine with a plurality of processing stations, positioned relative thereto and incorporates the present invention.

The term corotron as used in this application means a type of corona having either limited or no grid structure. In effect the corotron may be considered analogous to a current source.

The term scorotron as used in this application means a type of corona having a grid structure. The scorotron may be considered as a voltage source.

The term corona as used in the application is generic for corotron and/or scorotron.

For exaplanation purposes, the photoconductor in the preferred embodiment of the present invention will be described as a rotating drum. However, this should not be construed as a limitation on the scope of the invention; since it is well known in the art to design a photoconductor having a different shape, size and mechanical configuration. For example, the photoconductor may be a continuous belt or a plate rather than a rotating drum structure.

Although the preferred embodiment of the invention is described in association with a two cycle copying process, this should be interpreted as illustrative rather than restrictive, since it would be obvious for one skilled in the art to modify the inventive feature as disclosed hereinafter to make said concept operable in a one cycle copying process. In the drawings, similar elements are identified by identical numbers.

Figure 2:
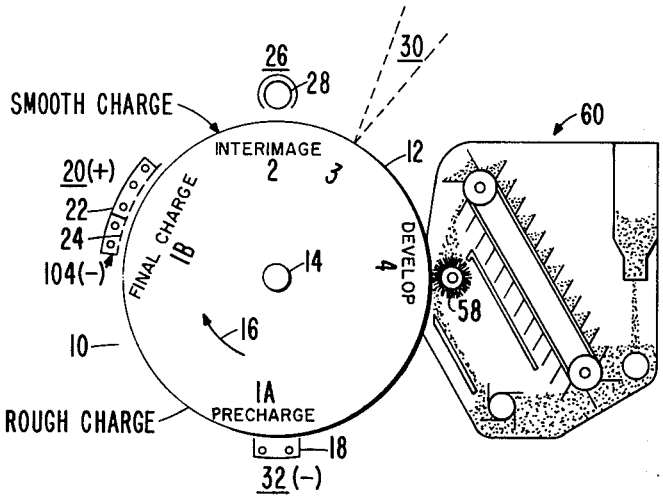
FIGS. 2 and 4 are a schematic diagram of a two cycle process electrophotographic machine showing a plurality of processing stations which is helpful in understanding the present invention.
Figure 4:
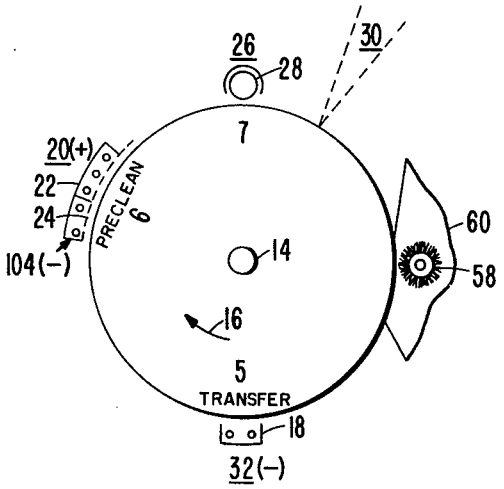

Referring now to FIGS. 1, 2 and 4, a schematic of an electrophotographic copying system 10 is shown. The end view of a cylindrical drum 12, hereinafter called the photoconductor, is mounted for rotation on shaft 14 and having on its outer periphery a photoconductive insulating layer which contains an organic or inorganic photoconductive material. The drum 12 is rotated to bring the photoconductive layer in spaced relationship with various stations associated with the electrophotographic process; each of said stations being positioned in proximity to the rotating drum.

A negative corotron 18 is positioned within the orbit of cylindrical drum 12 to define the so called precharge/transfer station 32. Negative corotron 18 of the precharge/transfer station serves two functions, namely: to deposit ions on the surface of the photoconductor, and to deposit ions on a transferring media, for example, paper which is introduced to the precharge/transfer station at paper path 62.

The polarity of the charge on the ions may be positive or negative depending on the type of electrophotographic system. In the preferred embodiment of this invention, the charge is negative. As will be explained subsequently, the negative charge which is deposited on the photoconductor by negative corotron 18 is rough; i.e., the charge is unevenly distributed on the surface of the photoconductor. Also, the same current level setting may be used for charging the photoconductor and for charging the transfer media which avoids the need to switch the current level of the precharge/transfer corona.

Although the magnitude of the charge may vary, it has been found and practiced in the preferred embodiment of the invention that the photoconductor is more uniformly charged when the magnitude of the charge, which is deposited on the photoconductor by the precharge/transfer corona, is less than the magnitude of the charge which is necessary for proper operation of the photoconductor. For example, the charge which is deposited on the photoconductor is approximately −800 volts while the operating voltage of the photoconductor is approximately −870 volts.

After precharge/transfer station 32, the next station in order is the combined final charge/preclean station 20, also referred to as the dual bay corona. Final charge/preclean station 20 is the facility which supplies ions (positive and/or negative) to overcharge the surface of the photoconductor in the first bay and to final charge the surface of the photoconductor in the second bay (with the opposite polarity charge) and renders the preclean function during the second cycle. As used in this application, overcharge means that the photoconductor is charged to a potential beyond its operating potential. This photoconductor charge is referred to as smooth due to the fact that the charge is evenly distributed over the surface of the photoconductor because of the cutoff characteristic produced by the control grid 24. As will be explained subsequently, the polarity of the emission wires in the first bay of the final charge/preclean corona is the same as the voltage applied by the precharge/transfer corona, so that a second stage of precharge is achieved that produces a smooth photoconductor charge because of the grid. In the preferred embodiment, a negative emission voltage is used in the first bay so that negative ions are generated. The polarity of the emission wires in the second bay is opposite to the polarity of the first bay, while the grid of the second bay is electrically common to the first bay and, therefore, has the same voltage. In the preferred embodiment, a positive emission voltage is used in the second bay so that positive ions are generated. This bay, therefore, charges the photoconductor in the positive direction from the overcharge level to the final desired dark charge level.

Still referring to FIGS. 1, 2 and 4, final charge/preclean station 20 comprises a dual bay corona which includes a trailing bay 22 and a leading bay 104. The trailing bay is sometimes referred to as a positive scorotron while the leading bay is called a negative scorotron. The positive scorotron supplies positive ions or charge while the negative scorotron supplies negative ions or charge. The negative ion which is supplied by the negative scorotron augments or increases the charge which is placed on the photoconductor by the combined precharge/transfer station. Stated another way, the photoconductor is overcharged to a given polarity by the negative scorotron. In the preferred embodiment, the photoconductor is overcharged to approximately −1100 volts. Likewise, the positive ions or charge which is supplied by the positive scorotron smooths or reduces the rough charge on the photoconductor to a voltage level at which the photoconductor is functional. In the preferred embodiments, the operating voltage of the photoconductor is approximately −870 volts.

The dual bay corona which overcharges and smooths the voltage on the photoconductor can take several structural design forms. For example, in the preferred embodiment of this invention, shown in FIGS. 1, 2 and 3, common corona case 104 defines both the leading negative scorotron and the trailing positive scorotron. The common case is interconnected to a common potential, for example, ground by conductor 100. Another alternative design which is contemplated by the present invention is a separate corona housing with separate cases defining the negative and positive scorotron.

Referring again to FIGS. 1, 2 and 3, common grid structure 24 is positioned between dual bay corona 20 and photoconductor 12. The common grid controls the flow of ions from the dual bay corona so as to deposit a uniform charge on the surface of photoconductor 12. For proper operation of the system, the dual corona bays must be controlled by a common grid structure. Again, the common grid may take various design forms. For example, a single set of grid wires, as is shown in the drawings, or separate sets of grid wires, one for each corona bay. In the design where separate sets of grid wires are used, then both grids must be connected to a common control means.

As will be explained subsequently, switching circuit 36 (shown in block diagram form in FIG. 1 and in more detail in FIG. 3) is connected to grid 24 to control the voltage on the grid. A plurality of grid control circuits can be generated without departing from the scope of the present invention. The voltage on the grid changes depending on whether the photoconductor is cleaned or charged. For example, in one instance the voltage on the grid is very negative (approximately −1000 volts), while in another instance the grid is positive (for example +200 or +400 volts). Still in another instance, the voltage is slightly negative and/or positive (approximately ± 50 volts) or ground.

Positioned downstream from the combined charge/preclean station is interimage station 26. Interimage station 26 incorporates interimage erase lamp 28. The erase lamp cleans or discharges the border area or no copy area of the photoconductor during the first cycle of the two cycle process and cleans or discharges the entire surface area of the photoconductor during the second cycle. The use of the erase lamp during the second cycle is optional.

The next station in order is the image station 30. Image station 30 comprises a conventional optical system which functions to transfer an image of a document onto the photoconductor. With the image on the photoconductor, the next station in line is the developer cleaner station 60. Developer cleaner station 60 is conventional. For example, the developer cleaner station is analogous to the developer cleaner station as disclosed in the above identified U.S. Pat. No. 3,637,306, entitled "Copying System Featuring Alternate Developing and Cleaning of Successive Image Areas for Photoconductor" and assigned to the same assignee of the present invention.

Figure 3:
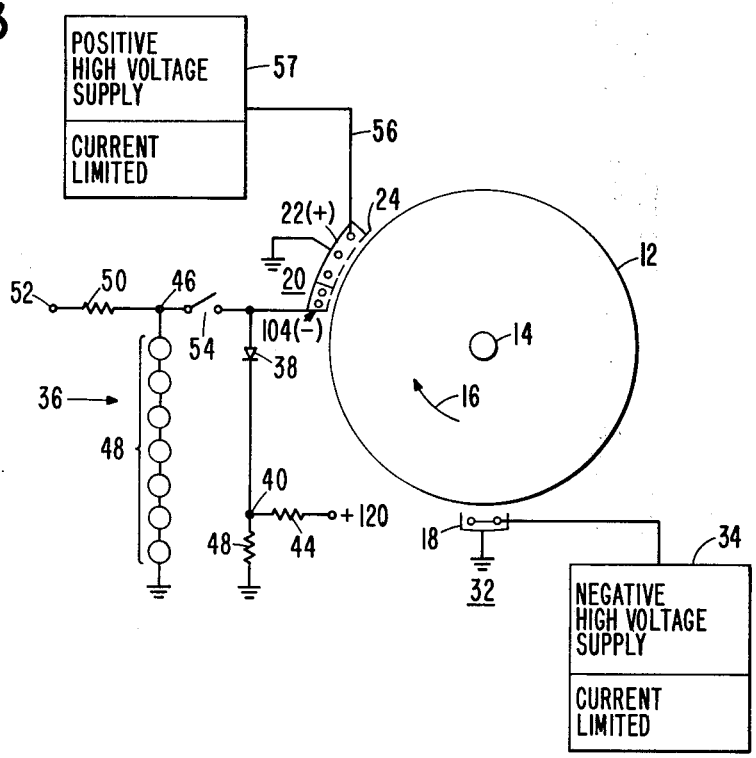
FIG. 3 is a schematic diagram showing one embodiment of a control circuit which changes the voltage of the control grid in the combined charge/preclean station.

Referring now to FIG. 3, one embodiment of a control means which controls the negative corotron 18 of precharged/transferred station 32 is disclosed. Also, an embodiment of control means 36 which switches the polarity of grid structure 24 from a first potential to a second potential is disclosed.

As was mentioned previously, negative corotron 18 of precharge/transfer station 32 supplies negative ions to the photoconductor in one cycle and in another cycle supplies negative ions to a transfer medium which accesses corotron 18 along paper path 62. In order to supply negative ions, a negative high voltage power supply 34, also called control means 34, is connected to corotron 18. Power supply 34 is set at a single current level for both charging the photoconductor and for charging the transfer media. As a result, a conventional 60 cycle power supply is used since current level does not have to be switched.

In an alternative embodiment of the invention, corotron 18 and the negative bay of the dual bay corona is interconnected to common voltage supply means 110 (FIG. 1).

Still referring to FIG. 3, grid structure 24, also called control means 24, functions as a limiting means for controlling the ions (positive and/or negative charge) which are deposited on the surface of photoconductor 12 from positive scorotron 22 and negative scorotron 104. The resulting photoconductor voltage is a function of the grid voltage. In order to effectuate this limiting or controlling effect, a switching means is operably connected to the grid for switching its voltage between two (or more) voltage levels.

Switching means 36 comprises a diode 38 hereinafter called unidirectional device 38. One terminal of the unidirectional device is connected to grid 24 while the other terminal is connected to positive terminal 40 hereinafter called third reference voltage source 40. Third reference voltage source 40 may be any positive value, negative value or ground. For example, in the preferred embodiment of this invention the value is ground.

Resistor 48, hereinafter called third resistor means 48, connects third reference voltage source 40 to a lower or equal potential. In the preferred embodiment of this invention, the low potential is ground. Likewise, another resistor 44, hereinafter called second resistor means 44, connects third reference voltage means 40 to a higher potential. In the preferred embodiment of the invention, the higher potential is chosen to be 120 volts.

In an alternate embodiment of the invention, third reference voltage source 40 is connected to a switchable preclean level supply. The preclean level supply can be adjusted to one of a plurality of voltage potentials. For example, typical voltage levels would be +400 volts to −400 volts or ground.

Reference voltage source 46 hereinafter called first reference voltage source 46 is positioned in parallel with third reference voltage source 40. The potential of first reference voltage source 46 is negative. In the preferred embodiment of this invention, a 1000 volt negative potential is chosen. First reference voltage source 46 is established by a conventional bank of neon tubes 48. Of course, it would be obvious to one skilled in the art to substitute conventional devices to establish first reference voltage source 46 without departing from the scope of this invention.

Resistor 50 hereinafter called first resistor means 50 is connected in series with first reference voltage source 46 so as to establish second voltage source 52. In the preferred embodiment of this invention, source 52 is chosen to be 1500 volts negative. In an alternate embodiment, second voltage source 52 is connected to a negative grid supply means. The negative grid supply means has a typical value of approximately −1500 volts. Switching means 54 interconnects unidirectional device 38 and first reference voltage source 46. The connection is such that by activating switching means 54 either the voltage at third reference voltage source 40 or the voltage at first reference voltage means 46 is rendered operative. Of course, several conventional switching devices may be used for switching means 54. However, in the preferred embodiment of this invention, switching means 54 was a high voltage read relay switch. Positive high voltage supply 57 supplies power to scorotron 22 via terminal 56. In the preferred embodiment, high voltage corona supplies 34 and 57 are current regulated so that they deliver a constant total current to the corona emission wires. This completes the detailed description of the preferred embodiment of the invention.

Although the above invention is described in relationship with a two corona charging scheme for an electrophotographic machine, the invention can be extended to cover a three corona charging scheme. In the three corona charging scheme application, the precharge/transfer corona is one of the coronas, while the negative bay of the dual bay corona and the positive bay of the dual bay corona are the other coronas.

OPERATION

In order to simplify the operation of the two cycle process, which embodies the present invention, the position of the processing station in relation with rotating cylindrical drum 12 is equated with positions on the face of a clock (see FIGS. 2 and 4). In operation, cylindrical drum 12 rotates in the direction shown by arrow 16. During the first cycle of the two cycle process (FIG. 2), step 1A occurs at 6:00. At 6:00, the precharge/transfer constant current negative corona 18 of precharge/transfer station 32 precharges the photoconductor of cylindrical drum 12 to a rough negative voltage. For example, the undercharge voltage is −800 volts.

The second step, 1B, occurs at 11:00 where the small negative leading bay (scorotron 104) of final charge/-preclean station 20 augments the photoconductor charge to approximately −1100 volts as controlled by grid 24 which has a setting of approximately −1000 volts. The overcharge. which is now on the photoconductor surface is reduced or smoothed to approximately −870 volts by the large positive trailing bay (scorotron 22) of the final charge preclean station. At 12:00, step 2 occurs; lamp 28 of interimage station 26 performs the interimage erase. At 1:00, step 3occurs; the photoconductor is imaged at image station 30, such that the photoconductor charge in a black image is approximately −840 volts, the photoconductor charge in a gray image is approximately −400 volts, and the erase background and white charge is from −150 to −180 volts.

At approximately 4:00, step 4 occurs; the latent image is developed by magnetic brush 58 of developer/cleaner station 60. The bias of magnetic brush 58 is approximately −350 volts. Thus, magnetic brush 58 is positive relative to the latent image and negative relative to the erased background. This completes the first drum cycle.

At 6:00, during the second drum cycle (FIG. 4), step 5 occurs; transfer media is gated along paper path 62 (FIG. 1) so that it moves between the corona and the drum. Negative corotron 18 of precharge/transfer station 32 charges the transfer media so as to provide the electrostatic force which causes the toned image on cyclindrical drum 12 to be transferred to the transfer media. The transfer media for example, paper, is held against drum 12 by electrostatic force only. In the preferred embodiment of the invention, the same corotron current setting is used for both precharge and transfer functions so that switching the current level is not necessary except at the end of a multicopy run when the unit must be turned off for the final clean cycle. Of course, one alternative embodiment would be to switch the current setting depending on whether the precharge function or the transfer function is being performed.

At approximately 11:00 during the second drum cycle, step 6 occurs; switching means 36 (FIG. 3), switches grid 24 so that the voltage from third reference source 40 appears on the grid 24 so that the charge on the photoconductor surface of rotating drum 12 is reduced to a voltage near ground by the positive ions from the second bay. In one embodiment the grid is set at approximately 0 volts. During this cycle the negative, or first, bay of the dual bay corona has negligible charging effect on the photoconductor due to the 0 volts on the control grid. This change in voltage accomplishes the preclean function.

At approximately 12:00 step 7 occurs; lamp 28 of interimage station 26 is energized to illuminate the entire photoconductor surface of rotating drum 12 which discharges the photoconductor to approximately 0 volts. At 1:00 during the second cycle, imaging station 30 may be on or off. The photoconductor then rotates to developer/cleaner station 60 where magnetic brush 58 removes residual toner from the photoconductor surface. This completes the two cycle process.

This unique configuration, as described above, has distinct advantages over prior art configurations, in that the requirement of high voltage power supply switching in short time intervals is eliminated. In addition, the combination of the two corona units requires one less power supply and one less corona unit for a sizable cost reduction.

Another advantage of this configuration is the fact that the transfer corona can be made smaller than would have been possible if the combined charge and transfer coronas were used. This is important in that significant reduction in the overall machine dimension is achieved.

Still another advantage of the present invention is that the overcharge for the photoconductor is more tightly controllable which improves long term reliability of copy quality. The electrostatic stress on the photoconductor is lessened since the overcharge on the photoconductor is less than is required heretofore.

The current density in the precharge/transfer corona is reduced which significantly reduces the propensity for arcing.

While the invention has been particularly shown and described with reference to a preferred embodiment thereof, it will be understood by those skilled in the art that various changes in form and details may be made therein without departing from the spirit and scope of the invention.

What is claimed is:

1. In a two cycle process, two corona electrophotographic machine where the photoconductor is being charged, imaged, toned, transferred and cleaned by stations positioned relative to said photoconductor, the improvement comprising in combination:

a combined charging and transfer station for charging the photoconductor and for charging a transfer means; and a combined overcharging and smoothing station; said station having a dual bay corona with one bay for overcharging the photoconductor and a second bay for smoothing and reducing the overcharge on said corona;

a common grid having a voltage level associated with the bays of the combined charging and smoothing station; and control means connected to the common grid and operable for switching the voltage level on the common grid so as to perform the cleaning or the charging of the photoconductor.

2. In a two cycle process electrophotographic apparatus having a photoconductor with the customary facilities to charge, image, develop, transfer and clean the improvement comprising:

a first charging means operable for charging the photoconductor surface to a first voltage level during the first cycle and for charging a transfer media to a second voltage level during the second cycle;

a second charging means positioned downstream of said first charging means; said second charging means operable for charging the photoconductor surface with a first controlled voltage and a second controlled voltage for smoothing the charge on said photoconductor and a third controlled voltage for precleaning the photoconductor; and a control grid means, associated with said said second charging means, operable to enable the charging, and the smoothing of the charge on the photoconductor and to enable the precleaning of the photoconductor.

3. The device as claimed in claim 2 where the second charging means includes:

a dual bay corona;

said dual bay corona having a first corona bay for generating ions with a first polarity;

a second corona bay for generating ions with a polarity opposite to the polarity of the ions being generated by the first bay;

first power supply means operably connected to the first corona bay; and second power supply means connected to the second corona bay.

4. The device as claimed in claim 2 further including switching means connected to the grid and operable for switching the grid to different voltage levels to effectuate cleaning or charging the surface of the photoconductor.

5. The device as claimed in claim 2, further including a common power supply connected to the first charging means and the second charging means.

6. The device as claimed in claim 2 wherein the magnitude of the first voltage level is less than the voltage level at which the photoconductor surface is imaged.

7. The device as claimed in claim 2 wherein the first controlled voltage has a polarity identical to the polarity of the first voltage level and operable to overcharge the surface photoconductor.

8. An improved two corona charging system for use with a two cycle process electrophotographic machine comprising:

a combined precharge and transfer corona, said corona being operable during the first cycle to charge a photoconductor to a first polarity and being operable during the second cycle to charge a transfer means;

a dual bay corona positioned downstream from the combined precharge and transfer corona; said dual bay corona having a first bay for depositing a charge, with a polarity substantially equivalent to the first polarity, on the photoconductor and a second bay for depositing a charge with opposite polarity for smoothing and reducing the charge on said photoconductor;

a common grid structure associated with the dual bay corona and operable to control the deposition of charge on the photoconductor;

control means operably connected to the grid structure;

power supply means operably connected to the coronas;

imaging means being positioned downstream from the dual bay corona and for creating an electrostatic image on the photoconductor;

developing means being positioned downstream from the imaging means for depositing toner particles on the electrostatic image and for cleaning the photoconductor; and transfer means associated with the photoconductor, for transferring the toned electrostatic image.

9. The device claimed in claim 8 wherein the combined precharge and transfer corona and one of the bays of the dual bay corona are connected to a common power supply means.

10. An improved two corona charging system for use with a two cycle process electrophotographic machine comprising:

a combined precharge and transfer corona, said corona being operable during the first cycle to charge a photoconductor to a first polarity and being operable during the second cycle to charge a transfer means;

a dual bay corona positioned downstream from the combined precharge and transfer corona; said dual bay corona having a first bay for depositing a charge, with a polarity substantially equivalent to the first polarity, on the photoconductor and a second bay for depositing a charge with opposite polarity for smoothing and reducing the charge on said photoconductor;

common grid structure associated with the dual bay corona;

control means operably connected to the grid structure;

power supply means operably connected to the coronas;

an intererase means for discharging the border areas of the photoconductor during the first cycle of the two cycle process and for discharging the entire surface area of the photoconductor during the second cycle of the two cycle process;

imaging means being positioned downstream from the dual bay corona and for creating an electrostatic image on the photoconductor;

11. In a two cycle process electrophotographic machine having a photoconductor surface with the customary facilities to charge, image, develop, transfer and clean, an improved charging system for said machine comprising:

a first corona for charging a transferring means to transfer a latent image from the photoconductor surface;

a dual bay corona positioned downstream from the first corona and operable for charging the photoconductor surface;

said dual bay corona includes a first bay for depositing a first charge having a potential which is in excess of the operating potential of said photoconductor and a second bay for depositing a second charge for smoothing and reducing the first charge on said photoconductor;

a common grid structure associated with the dual bay corona and operable to control electron flow from the dual bay corona to charge the surface of the photoconductor; and switching means connected to the common grid structure;

said switching means being operable during the first cycle to a first voltage level on the common grid structure and to set a second voltage level on the common grid structure during the second cycle of said two cycle process whereby the first bay of the dual bay corona has negligible charging effect on the surface of the photoconductor during the second cycle to enable precleaning of the photoconductor.

12. The device claimed in claim 11 wherein the first voltage level on the grid structure is substantially equivalent to $-1000$ volts.

13. The device claimed in claim 12 wherein the second voltage level on the grid structure is 0 volts.

* * * * *

UNITED STATES PATENT AND TRADEMARK OFFICE

CERTIFICATE OF CORRECTION

PATENT NO. : 4,141,648

DATED : February 27, 1979

INVENTOR(S) : Ronald E. Gaitten
Gerald L. Smith

It is certified that error appears in the above-identified patent and that said Letters Patent are hereby corrected as shown below:

Column 10, line 10, delete "said" second occurrence.

Column 12, line 3, after "photoconductor;" add the following paragraphs:

--developing means being positioned downstream from the imaging means for depositing toner particles on the electrostatic image and for cleaning the photoconductor; and transfer means associated with the photoconductor, for transferring the toned electrostatic image.--.

Column 12, line 28, after "to" insert --set--.

The title of the patent should read --PHOTOCONDUCTOR CHARGING TECHNIQUE AND APPARATUS THEREFORE--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*